United States Patent [19]

Jean et al.

[11] 4,134,574

[45] Jan. 16, 1979

[54] DEVICE FOR STRINGING AN ELECTRICAL CONDUCTOR IN AN INSULATOR

[75] Inventors: Leonard P. Jean, Nashua; Ernest J. LaChance, Sr., Milford, both of N.H.

[73] Assignee: Hendrix Wire & Cable Corp., Milford, N.H.

[21] Appl. No.: 830,660

[22] Filed: Sep. 6, 1977

[51] Int. Cl.[2] ..... B65H 59/00

[52] U.S. Cl. ..... 254/134.3 R

[58] Field of Search ..... 254/134.3 R, 134.3 PA; 174/154–157, 65 R; 308/237 R

[56] References Cited

U.S. PATENT DOCUMENTS

| | | | |
|---|---|---|---|
| 1,898,614 | 2/1933 | Brady | 174/155 |
| 2,515,724 | 7/1950 | McCroskey | 254/134.3 R |
| 2,945,085 | 7/1960 | Billups | 174/156 |
| 3,543,457 | 12/1970 | Budlong | 174/65 R |

*Primary Examiner*—Robert C. Watson

*Attorney, Agent, or Firm*—Robert L. Thompson

[57] ABSTRACT

This disclosure is directed to a device for stringing an electrical conductor on an insulator above the ground for aerial power distribution or transmission. The stringing device includes first and second semi-tubular members each of which has an outwarddly extending flange at one end and means for detachably securing the semi-tubular members together to form a circular passage between them. One embodiment also includes first ear means projecting outwardly from one side of the flange means of the first semi-tubular member, second ear means projecting outwardly from one side of the outwardly extending flange of the second semi-tubular member, the ear means includes transverse orifices which register with each other when the semi-tubular members are detachably secured together and means passing through the registering orifices for preventing complete separation of the semi-tubular members when the means for detachably securing them together is released.

4 Claims, 12 Drawing Figures

DEVICE FOR STRINGING AN ELECTRICAL CONDUCTOR IN AN INSULATOR

CROSS-REFERENCE TO RELATED APPLICATION

Subject matter disclosed herein is disclosed and claimed in copending patent application filed Sept. 6, 1977 and herewith incorporated by reference herein: Ser. No. 830,671 filed by Leonard Paul Jean and Ernest Joseph LaChance, Sr.

BACKGROUND OF THE INVENTION

This invention relates to a device for stringing an electrical conductor on an insulator above the ground for aerial power distribution or transmission.

The conductors to be strung may be either insulated cables or conductors of the bare wire type.

There has been a long-felt need for such a stringing device which is economical to manufacture and to use and which may be used with an insulator which will accept the device and permit a conductor to be installed and tensioned on a plurality of insulators without the use of the customary stringing roller blocks or a temporary stringing pin insulator and the usual temporary support of the conductor while the stringing device is removed and a permanent insulator is installed.

There has also been a long-felt need for such a stringing device which is not subjected to excessive wear when the conductor is pulled through it during the stringing operation and which can be used repeatedly from job to job.

U.S. Pat. No. 3,739,075 dated June 12, 1973, owned by Hendrix Wire & Cable Corporation, the assignee of the present application, discloses one unsuccessful attempt to meet said long-felt needs. In the insulator of that patent, the body of the insulator was provided with a cylindrical eye 15 having a circular passage 16 through which the conductor cable was pulled during the stringing step. Because the diameter of the passage 16 was much greater than the diameter of the conductor, it was necessary to use wire means 38, wire means 43 or elastic tie means 45 to hold the conductor in the passage 16. Installation of such means was very time consuming. In addition, the cylindrical eye 15 was not made of a sufficiently wear-resistant plastic to prevent excessive wear when the conductor was pulled through it during stringing.

Reliable Electric Company's, Synthetic Products Company Division, attempted to meet the long-felt need with a temporary stringing pin insulator which accommodates conductors up to $1\frac{7}{8}''$ in diameter. This stringing pin insulator is shown in U.S. Pat. No. Des. 235,190. As an accessory, a channel shaped replacable insert is available to limit wear of the temporary insulator but it is not cylindrical and cannot be rotated to distribute wear from job to job.

To the best of our knowledge, the above described prior art is the closest prior art to the stringing device of the present invention.

BRIEF SUMMARY OF THE INVENTION

One object of this invention is to provide a new device for stringing an electrical conductor on an insulator above the ground for aerial power distribution or transmission.

Another object is to provide such a stringing device which is economical to manufacture and to use.

A further object is to provide such a stringing device which may be used with an insulator which will accept the stringing device and permit a conductor to be installed and tensioned on a plurality of insulators without the use of customary stringing roller blocks or temporary stringing insulators.

Another object is to provide such a stringing device which will accommodate conductors having diameters of up to $1\frac{3}{4}''$.

Yet another object is to provide such a stringing device which requires only three parts, at least the major portions of which are molded from a plastic material.

Yet another object is to provide such a stringing device which is resistant to wear when the conductor is pulled through it during the stringing operation and which can be used repeatedly from job to job.

A still further object is to provide such a stringing device which allows a conductor to be installed and tensioned on a plurality of insulators without the use of the usual temporary support of the conductor while the stringing device is removed and the permanent insulator is installed.

Yet another object is to provide such a stringing device which can be easily removed from the conductor after it has performed its function.

Further objects and advantages of the stringing device embodying this invention will be apparent to persons skilled in the art from the following description taken in conjunction with the accompanying drawings.

In general, a stringing device embodying this invention includes a first semi-tubular member having outwardly extending flange means at one end, a second semi-tubular member having outwardly extending flange means at one end and means for detachably securing the semi-tubular members together to form a circular passage extending between them.

In a preferred embodiment, the means for detachably securing the semi-tubular members together comprises tongue and groove means on the abutting edges of the semi-tubular members.

In another embodiment, the stringing device includes first ear means projecting outwardly from one side of the flange means of the first semi-tubular member and second ear means projecting outwardly from the corresponding side of the flange means of the second semi-tubular member, each of the first and second ear means is provided with a transverse orifice and the orifices register with each other when the semi-tubular members are detachably secured together. It also includes means passing through the registering orifices for preventing complete separation of the first and second semi-tubular members when the means for detachbly securing them together is released.

In another embodiment, the means passing through the registering orifices is ring means.

In still another embodiment, the means for detachably securing the semi-tubular members together also includes mating projections and cavities on the adjacent faces of the flange means.

In another embodiment, the stringing device includes third ear means projecting outwardly from the side of the first flange means which is opposite to the side of the first flange means which includes the first ear means and a transverse orifice extends through the third ear means.

In a preferred embodiment, at least the major portions of the semi-tubular members are made from a moldable plastic material which is wear resistant.

In one embodiment each semi-tubular member includes at least one metallic strip means embedded in its inner surface and the metallic strip means forms a portion of the wall of the circular passage of the stringing device.

In another embodiment each semi-tubular member includes at least two spaced metallic strip means embedded in its inner surface, one adjacent to one end thereof and the other adjacent to the other end thereof, and the metallic strips form portions of the wall of the circular passage of the stringing device.

In yet another embodiment, each of the semi-tubular members also include spaced rib means extending around its outer peripheral surface.

In still another embodiment, the outwardly extending flange means of the semi-tubular members include outwardly extending convex surfaces, the inner portions of which merge with the circular passage of the stringing device when the semi-tubular members are in their closed positions.

It will be apparent to persons skilled in the art that a stringing device embodying the invention has solved the above described long-felt needs and has satisfied the above described objects.

DETAILED DESCRIPTION OF THE STRINGING DEVICE SHOWN IN THE DRAWINGS

Figure 1:
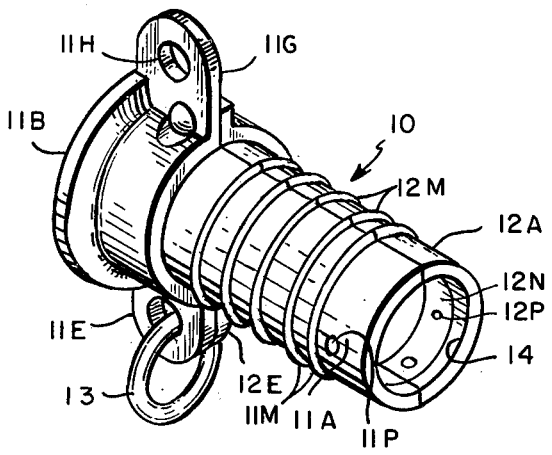
FIG. 1 is an isometric view of a fully assembled device for stringing an electrical conductor embodying the invention.

A stringing device embodying the invention is indicated generally by the numeral 10 in the drawings. It comprises a first semi-tubular member 11A having outwardly extending flange means 11B and a second semi-tubular member 12A having outwardly extending flange means 12B.

The semi-tubular member 11A is provided with tongue means 11C and groove means 11D. The semi-tubular member 12A is provided with tongue means 12C and groove means 12D.

Figure 2:
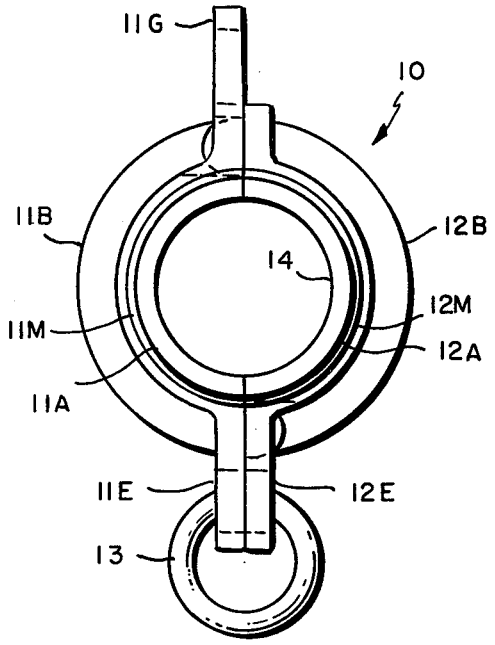
FIG. 2 is an enlarged end view of the stringing device of FIG. 1 showing the circular central passage, the end flanges and the outwardly extending ear means.

When the semi-tubular members are moved to the closed position of FIGS. 1 and 2, the tongue means 11C enters the groove means 12D and the tongue means 12C enters the groove means 11D thus detachably securing the two semi-tubular members together.

First ear means 11E projects outwardly from one side of the flange means 11B and second ear means 12E projects outwardly from one side of the flange means 12B. These ear means are provided with transverse orifices 11F and 12F which register when the semi-tubular members are closed as shown in FIGS. 1 and 2.

Figure 3:
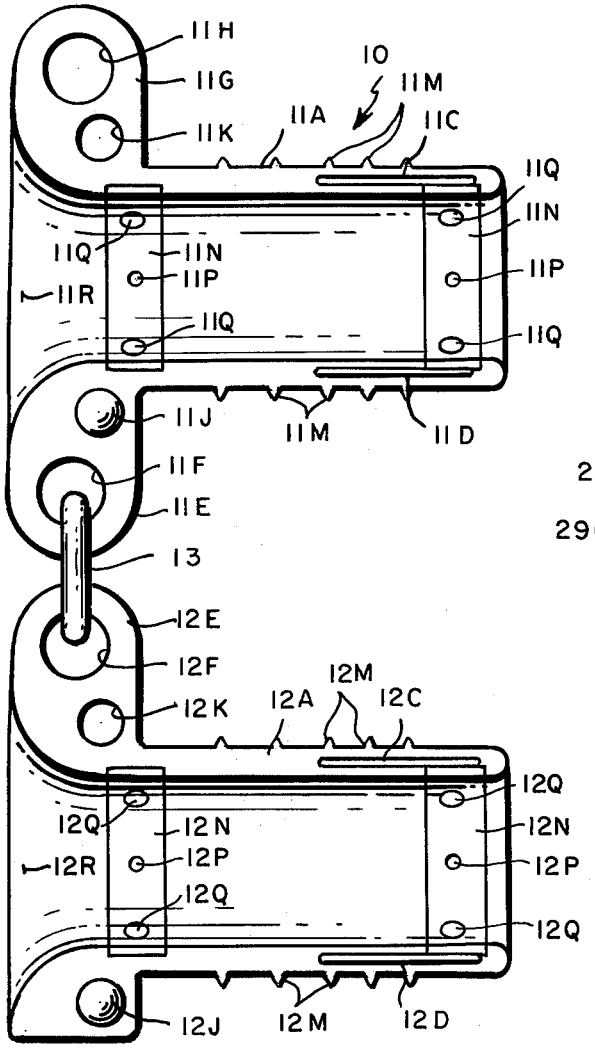
FIG. 3 is an enlarged top plan view of the stringing device partially disassembled showing the tongues and grooves formed in the edges of the semi-tubular parts of the device for detachably securing them together when they are assembled in the forms of FIGS. 1 and 2.

The ring means 13 passes through the orifices 11F and 12F as shown in FIGS. 1 and 3 thus preventing complete separation of the semi-tubular members.

Third ear means 11G projects outwardly from the flange means of the semi-tubular member 11A and this ear means is provided with a transverse orifice 11H for use with a hot stick when the conductor to be strung is to be energized before removal of the stringing device.

When the stringing device is in its assembled position of FIGS. 1 and 2, a circular passage 14 is formed between them. The diameter of the passage 14 is such that it will accommodate conductors having diameters up to $1\frac{3}{4}''$.

The outwardly extending flange mens 11B and 12B have outwardly extending convex surfaces, the inner portions of which merge with the circular passage 14 when the semi-tubular members are in their closed positions.

The tongue and groove means is so formed that the two semi-tubular members can be separated to the open position of FIG. 3 very easily by a workman.

The semi-spherical projecting members 11J and 12J enter the semi-spherical cavities 12K and 11K respectively when the semi-tubular members are closed, thereby cooperating with the tongue and groove means 11C–12D and 11D–12C to detachably secure the semi-tubular members together.

Spaced rib means 11M and 12M extend around the peripheral surfaces of the semi-tubular members 11 and 12 respectively.

For use with a transmission or distribution line which does not have sections which turn at a substantial angle to each other, the stringing device may be made entirely of a moldable, wearresistant plastic material. Examples of suitable materials are glass-filled acetol, glass-filled polyphenolinesulfide and glass-filled nylon.

Figure 10:
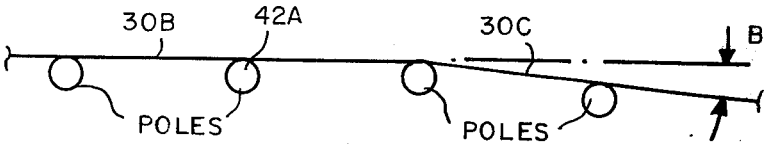
FIG. 10 is a plan view of a transmission or distribution line with two sections of the line turning at a substantial angle to each other.

However, for use with a transmission or distribution line in which sections 30B and 30C turn at a substantial angle to each other, for example at an angle of more than about 5° as shown by the angle B in FIG. 10, spaced metallic strip means 11N and 12N, preferably made of steel, are embedded in the inner surfaces of the semi-tubular members 11A and 12A respectively. These metallic strip means are better able to resist the wearing effect of ropes and conductor cables than all plastic semi-tubular members when ropes and conductor cables are pulled through the stringing device to install the conductor cables in the manner which is described below.

To correctly locate these metallic strip means in the semi-tubular members when the semi-tubular members are molded, locating pins (not shown) are inserted in the centrally disposed orifices 11P and 12P before the plastic material is introduced into the mold. During the molding step, platic material passes into the end orifices 11Q and 12Q and that plastic material as well as the plastic material which is located adjacent to the sides of the metallic strips securely holds them in the semi-tubular members after the plastic material has set.

An insulator for use with a stringing device embodying the invention is shown in FIGS. 4, 5, 8, 9, 11 and 12 of the drawings.

The insulator 20 comprises a body 21, having first jaw means 22 extending upwardly therefrom. The first jaw means has a generally concave inner surface 22A.

The generally U-shaped slot means 23 (FIG. 8) extends through the body substantially normal to the first jaw means and it comprises a pair of groove means 23A and 23B, one extending longitudinally of one side of the slot means and the other extending longitudinally of the other side thereof.

The insulator also comprises slide means 25 which comprises a pair of outwardly projecting members 25A (FIGS. 9 and 12) on opposite sides thereof which are slideable longitudinally in said groove means.

A passage 27 (FIGS. 9, 11 and 12) extends through the wall of the body beneath the first jaw means.

An interiorly threaded passage 25B (FIGS. 8, 9 and 12) extends longitudinally within the slide means and its axis substantially coincides with the longitudinal centerline of the passage 27.

Second jaw means 25C extends upwardly from the slide means. This jaw means has a generally concave inner surface 25D facing the generally concave inner surface of the first jaw means 22A.

First bolt means indicated generally by the numeral 29 (FIG. 5) has an exteriorly threaded portion 29A the threads of which engage the threads of the interiorly threaded passage 25B of the slide means.

The first bolt means comprises a second head means 29B which is shaped to receive a wrench for rotating the first bolt means. It also comprises a first head means 29C which is provided with eye means 29D adapted to receive a hot stick or a rod shaped tool for use in rotating the first bolt means.

The first bolt means also comprises a portion of reduced diameter 29E between the first and second head means.

Figure 8:
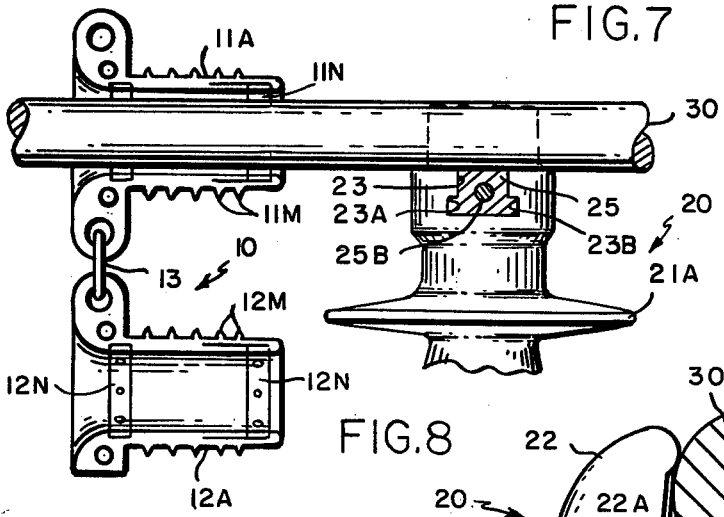
FIG. 8 is a section on the line 8—8 of FIG. 9 showing the stringing device slipped longitudinally of the conductor after the first and second jaw means of the insulator have been separated, ready for removal of the stringing device from the conductor.

The surface of the second head means which faces the body is provided with a pair of protrusions 29F which engage the body when the first bolt mens is tightened so that a conductor 30 is gripped between the first and second jaw means as shown in FIG. 8. These protrusions serve as an anti-loosening device like a lock washer.

The thread of the first bolt means is non-standard providing a rapid feed and preventing substitution of the first bolt means with a standard metallic bolt.

To tighten the first and second jaw means about a conductor, a hot stick or other tool is inserted in the orifice 29D of the first head means by a workman and he rotates the first bolt means manually until it shears at the portion of reduced diameter 29E and the first means falls away from the second head means. This prevents damage to the conductor and jaw means and prevents overstressing the first bolt means.

When it becomes necessary to remove the conductor, the first bolt means is loosened by a wrench which fits the second head means 29B.

The insulator body is provided with a series of spaced fin means 21A, 21B and 21C which extend outwardly therefrom generally normal to the longitudinal axis of the body. These fin means increase the leakage resistance path from the conductor to ground as is well known in the prior art.

Preferably, the insulator body and slide means are made of moldable plastic material which has a low dielectric constant and is weather and track resistant. Examples are high-density, track-resistant polyethylene, polypropylene and similar tough, electrical grade insulating materials.

Preferably the first bolt means is made of glass-filled nylon colored black for weather resistance. A specific type of glass-filled nylon is Nylon 616 30% glass, obtainable from DuPont or Liquid Nitrogen Processing Corp.

The body 21 comprises an axial passage (not shown), the upper portion of which is interiorly threaded to receive the exteriorly threaded upper end of the second bolt means 40. This second bolt means may be made of metal, a preferred embodiment being a galvanized steel body containing lead thread at the top as is well known in the prior art.

Figure 5:
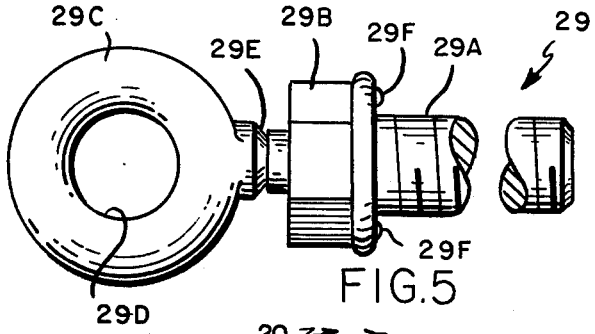
FIG. 5 is a top plan view of a bolt means with parts broken away.
Figure 6:
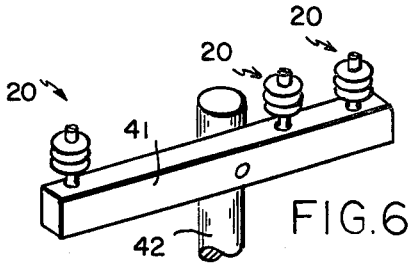
FIG. 6 is a fragmentary isometric view of a pole of a three-phase electric transmission or distribution line with three insulators mounted on a cross piece of the pole.

The second bolt means is used to mount an insulator 20 on a cross arm 41 of a transmission or distribution line pole 42 as shown in FIG. 6. It can also be used to mount an insulator on a bracket which is secured to the side of a transmission or distribution line pole as shown in FIGS. 2 and 5 of U.S. Pat. No. 3,739,075.

When a conductor is to be installed on a series of poles which are arranged in a substantially straight line, the first and second jaw means of the insulators are used in combination with stringing devices.

Figure 4:
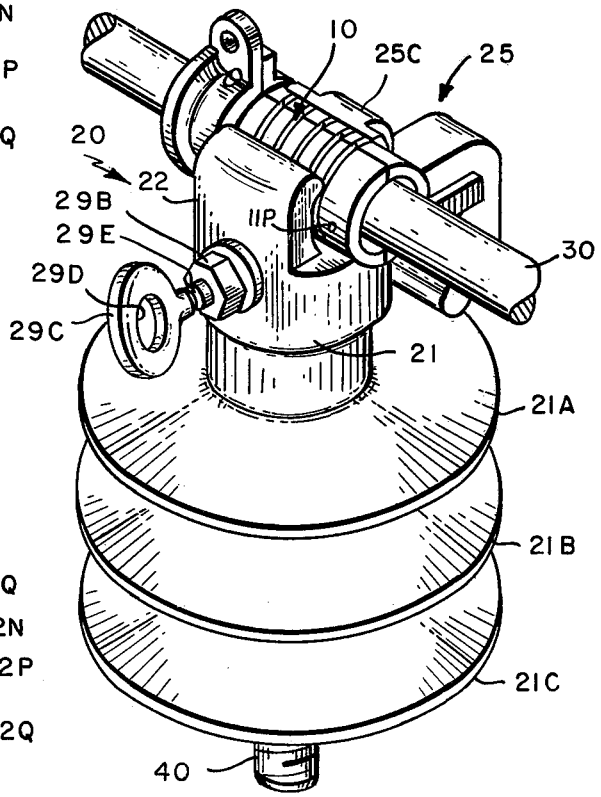
FIG. 4 is an isometric view of an insulator showing the upwardly extending first and second jaw means of the insulator gripping a stringing device and an electrical conductor extending through the stringing device.
Figure 7:
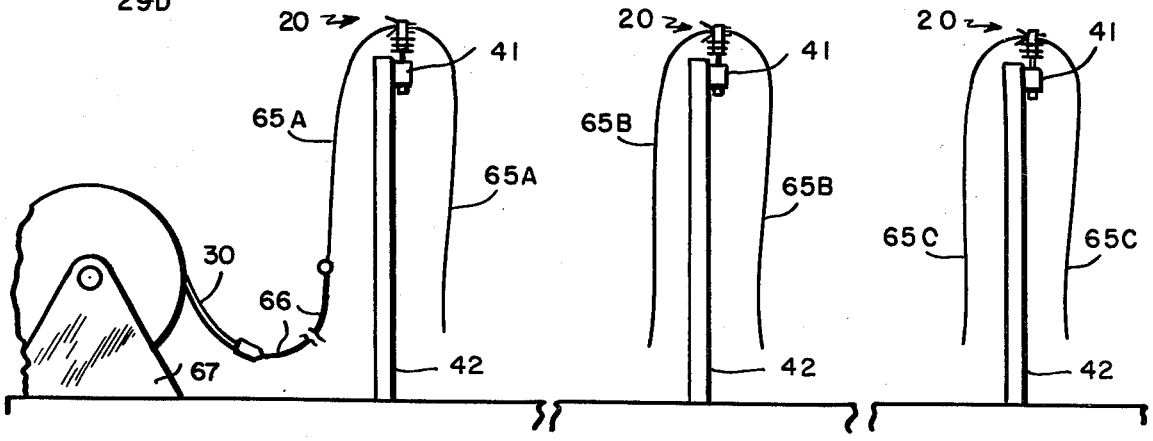
FIG. 7 is a diagrammatic side elevation of three poles of a transmission or distribution line having stringing devices mounted between the upwardly extending jaws of the insulators, a reel of electrical conductor and means for pulling the conductor successively through the stringing devices.

First a plurality of insulators 20 are mounted on a plurality of cross arms 41 of poles 42, as shown in FIG. 7. Then a plurality of stringing devices 10 are secured between the first and second jaw means of the insulators by tightening the first bolt means without shearing them at their portions of reduced diameter as shown in FIG. 4. The spaced rib means 11M and 12M serve to prevent the stringing devices from being withdrawn longitudinally from the jaw means when they are closed. Then separate hand lines 65A, 65B, 65C are passed from the ground up through the circular passages 14 of the stringing devices, as shown in FIG. 7. Then one end of the first hand line 65A is attached to the leading end of a pulling rope 66 and the leading end of the pulling rope is pulled through the passage 14 of the first stringing device by pulling the hand line. Then the first hand line is detached from the pulling rope and the end of the second hand line 65B is attached to the leading end of the pulling rope. The leading end of the pulling rope is then pulled through the circular passage 14 of the second stringing device which is held between the first and second jaw means of the insulator installed on the cross arm of the second pole. Then the leading end of the pulling rope is detached from the second hand line 65B. The same procedure is repeated with the succeeding hand lines until the pulling rope has been pulled through all of the stringing devices of a plurality of poles, for example 18.

The trailing end of the rope has been attached to the leading end of the conductor 30 which may be mounted on a reel 67. Then by means of a winch or other pulling apparatus attached to the leading end of the pulling rope, the conductor is pulled through the passages 14 of the series of stringing devices and the conductor is tensioned so that the sags between the poles are of the desired magnitude.

During this step, the convex surfaces 11R and 12R of the flange means 11B and 12B prevent abrasion of the pulling rope and the insulation of the conductor.

Then the first and second jaw means of the insulators are successively opened by loosening the first bolt means 29 and the stringing devices are successively slid longitudinally of the conductor outwardly of the jaw means by use of the ear means 11G. Then the semi-tubular halves of the stringing devices are separated as shown in FIG. 8 and they fall away from the conductor.

Figure 9:
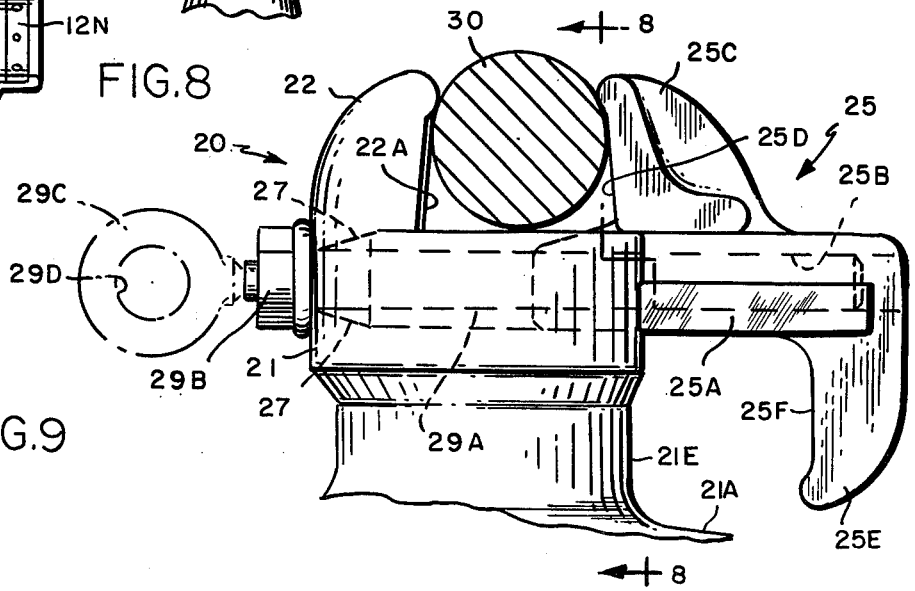
FIG. 9 is a side elevation of an insulator showing the conductor gripped between the upwardly extending first and second jaw means after the stringing device has been removed.

Then the first bolt means of the first insulator is tightened by manipulation of the first head means 29C until it is separated from the remainder of the first bolt means by shearing at the portion of reduced diameter 29E. This causes the first and second jaw means to grip the conductor 30 with the proper pressure to prevent damage to it as shown in FIG. 9.

Then the same procedure is successively repeated until the conductor is installed between first and second jaw means of all of the insulators.

In use of the method for installing a three-phase transmission or distribution line of the type shown in FIG. 6, after installation of the first conductor, the same stringing method is repeated for installing the second conductor and then repeated again for installation of the third conductor.

The stringing device can be used many times because it can be rotated about its longitudinal axis to different positions when installed between the jaws of the insulator thereby preventing excessive wear on any portion of the inner surface of the circular opening 14 which would otherwise occur if it was always installed in the same position between the jaws on all jobs.

Figure 11:
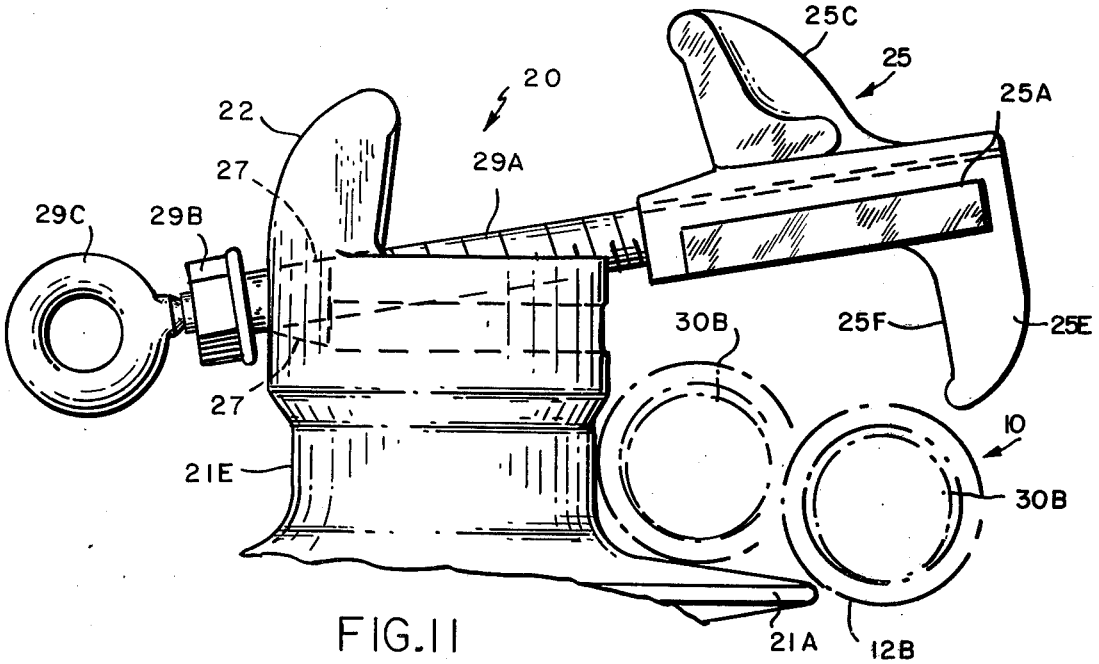
FIG. 11 is a side elevation showing the slide means and first bolt means of the insulator rotated upwardly to provide a gap between the lower end of the third jaw means and upper fin means of the insulator, the gap being of sufficient width to receive a stringing device and a conductor cable which are shown in dot dash.
Figure 12:
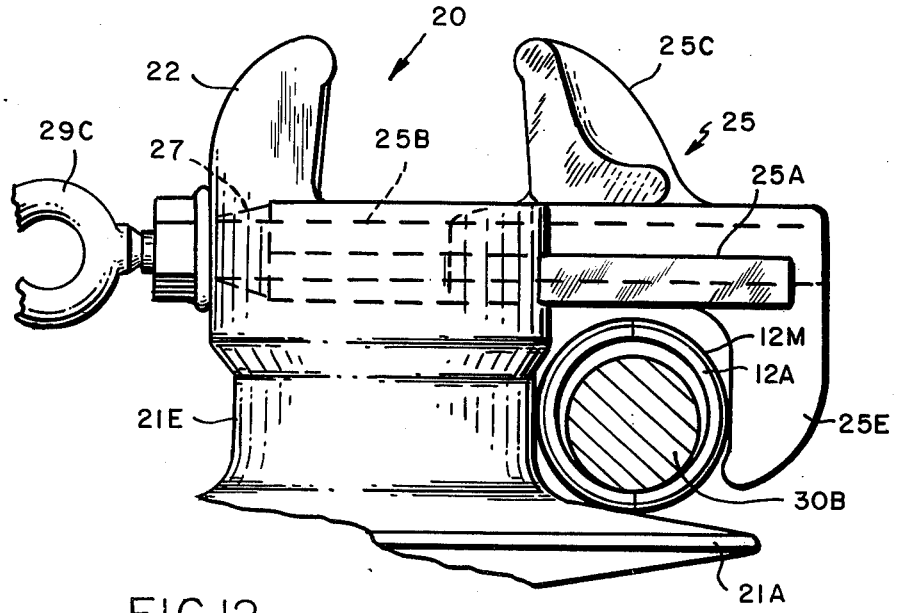
FIG. 12 is a side elevation like FIG. 11 showing the third jaw means closed to grip a stringing device between it and a portion of the neck of the insulator, the conductor cable being shown in section.

The slide means 25 of the insulator 20 also comprises downwardly extending third jaw means 25E which has a generally concave inner surface 25F facing the generally concave surface of a portion of the neck 21E of the body above the upper fin means 21A as shown in FIGS. 9, 11 and 12.

The inner ends of the pair of outwardly projecting members 25A of the slide means terminate at localities which are spaced inwardly of the end of the slide means which is opposite to the third jaw means as shown in FIG. 11. The walls of the passage 27 diverge inwardly as shown in FIGS. 11 and 12. By unscrewing the first bolt means 29, the combined third jaw means and first bolt means can be rotated upwardly a sufficient distance to permit a conductor 30B and stringing device 10 to be passed through the gap which is formed between the lower end of the third jaw means and the periphery of the upper fin means as shown in dot dash lines in FIG. 11. When the combined third jaw means and first bolt means are rotated downwardly and the first bolt means 29 is tightened, the stringing device 10 is gripped between the generally concave surface of the third jaw means and the generally concave surface of the neck portion 21E of the body as shown in FIG. 12.

The third jaw means may be used in connection with a stringing device all parts of which are made entirely of wear-resistant plastic when the angle B between the sections 30B and 30C is about 5° or less.

However, when the angle between the sections is more than about 5°, a stringing device in which each of the semi-tubular members includes at least one metallic strip means 11N and 12N is recommended because the friction of the pulling ropes 65A, 65B, 65C etc. and/or the conductor cable passing through the circular passage of the stringing device at a substantial angle causes increased wear of the ends of the walls of the circular passage of the stringing device.

The method of installing a conductor cable on a transmission or distribution line in which sections of the line turn at one or more substantial angles at one or more poles is the same as the method for a substantially straight line except that the stringing device is gripped between the third jaw means 25E and a substantially convex portion of the neck 21E of the insulator as shown in FIG. 12 and after the cable has been strung and the stringing devices have been removed from the cable as shown in FIG. 8, the bolt 29 is tightened so that the conductor cable is gripped between the third jaw means and said substantially convex portion of the neck 21E of the insulator.

While stringing devices which include metallic strip means are more expensive to manufacture than all plastic stringing devices, it may be desirable to stock only the former because they can be used on straight transmission or distribution lines as well as on lines portions of which turn at a substantial angle.

Use of the stringing device embodying this invention is much more economical than the prior art because it eliminates the necessity for the use of stringing roller blocks or temporary stringing insulators and the temporary support of the conductor while a stringing device is removed and the permanent insulator is installed.

The stringing device claimed herein satisfied the long-felt need and attains the objects of the invention as stated above.

The insulator shown and described herein and the methods of stringing conductors shown and described herein are claimed in another U.S. patent application signed by us which is being filed in the Patent and Trademark Office concurrently with this application.

While one desirable embodiment of a stringing device embodying the invention has been shown in the drawings, it is to be understood that this disclosure is for the purpose of illustration only, and that various changes in shape, proportion and arrangement of parts as well as the substitution of equivalent elements for those shown and described herein may be made without departing from the spirit and scope of the invention as set forth in the appended claims.

We claim:

1. A device for stringing an electrical conductor in an insulator comprising, a first semi-tubular member having outwardly extending flange means at one end, a second semi-tubular member having outwardly extending flange means at one end, at least the major portions of said semi-tubular members being made from a moldable plastic material which is wear resistant, means for detachably securing said semi-tubular members together to form a circular passage extending between them, and each semi-tubular member comprising at least one metallic strip means embedded in its inner surface, said metallic strip means forming a portion of the wall of said circular passage.

2. A device according to claim 1 wherein each semi-tubular member comprises at least two spaced metallic strip means embedded in its inner surface, one adjacent to one end thereof and the other adjacent to the other end thereof, said metallic strip means forming portions of the wall of said circular passage.

3. A device for stringing an electrical conductor in an insulator comprising, a first semi-tubular member having outwardly extending flange means at one end, a second semi-tubular member having outwardly extending flange means at one end, means for detachably securing said semi-tubular members together to form a circular passage extending between them, each of said outwardly extending flange means having a convex inner surface, the inner portions of said convex inner surfaces merging with said circular passage of the stringing device when said semi-tubular members are in closed position, whereby an electrical conductor can be pulled through the stringing device in sliding contact with a portion of at least one of said convex inner surfaces when said semi-tubular members are in closed position, a first ear means projecting outwardly from one side of the flange means of said first semi-tubular member, second ear means projecting outwardly from the corresponding side of the flange means of said second semi-tubular member, each of said first and second ear means being provided with a transverse orifice, said orifices registering with each other when said semi-tubular members are detachably secured together, and ring means passing through said registering orifices for preventing complete separation of said first and second semi-tubular members when said meaans for detachably securing them together is released.

4. A device according to claim 3 which also comprises third ear means projecting outwardly from the side of the first flange means which is opposite to the side of the first flange means which includes the first ear means and a transverse orifice extending through said third ear means.

* * * * *

UNITED STATES PATENT OFFICE

CERTIFICATE OF CORRECTION

PATENT NO. : 4,134,574

DATED : January 16, 1979

INVENTOR(S) : Leonard P. Jean and Ernest J. LaChance, Sr.

It is certified that error appears in the above-identified patent and that said Letters Patent are hereby corrected as shown below:

ABSTRACT, line 5, the word "outwarddly" should be --outwardly--;

Column 4, line 46, the word "mens" should be --means--;

Column 4, line 66, the word "wearresistant" should be --wear-resistant--;

Column 5, line 66, the word "mens" should be --means--;

Column 6, line 10, after "first" insert --head--;

Column 10, claim 3, line 21, "meaans" should be --means--.

Signed and Sealed this

*Tenth* Day of *July 1979*

[SEAL]

*Attest:*

*Attesting Officer*

LUTRELLE F. PARKER

*Acting Commissioner of Patents and Trademarks*